US008985898B2

(12) United States Patent
Tomlinson

(10) Patent No.: US 8,985,898 B2
(45) Date of Patent: Mar. 24, 2015

(54) PNEUMATIC ANCHORING SYSTEM FOR WICK DRAINS

(71) Applicant: Dean Tomlinson, Parker, CO (US)

(72) Inventor: Dean Tomlinson, Parker, CO (US)

( * ) Notice: Subject to any disclaimer, the term of this patent is extended or adjusted under 35 U.S.C. 154(b) by 88 days.

(21) Appl. No.: 13/651,937

(22) Filed: Oct. 15, 2012

(65) Prior Publication Data

US 2013/0279984 A1 Oct. 24, 2013

Related U.S. Application Data

(60) Provisional application No. 61/547,423, filed on Oct. 14, 2011.

(51) Int. Cl.
*E02D 3/10* (2006.01)

(52) U.S. Cl.
CPC ..... *E02D 3/103* (2013.01)
USPC ..... 405/50; 405/247

(58) Field of Classification Search
USPC ..... 405/50, 247, 246, 245, 232, 231
See application file for complete search history.

(56) References Cited

U.S. PATENT DOCUMENTS 3,881,319 A * 5/1975 Katagiri et al. ..... 405/50
3,928,979 A * 12/1975 Terashima et al. ..... 405/50
3,958,647 A * 5/1976 Chelminski ..... 173/127
4,745,979 A * 5/1988 Morimoto ..... 173/184
6,312,190 B1 * 11/2001 Goughnour ..... 405/36
7,566,188 B2 * 7/2009 Morizot et al. ..... 405/50
7,726,913 B1 * 6/2010 Sjogren ..... 405/232

* cited by examiner

*Primary Examiner* — Benjamin Fiorello
*Assistant Examiner* — Kyle Armstrong
(74) *Attorney, Agent, or Firm* — Ober, Kaler, Grimse & Shriver; Royal W. Craig

(57) ABSTRACT

A pneumatic anchoring system for installation and anchoring of wick drains in a material to be consolidated such as soil, sand, ore or the like, comprising an excavator or crane having an elongate support mast and a tubular wick drain mandrel supported by the mast for downward penetration of the material/soil. The mandrel is capped at one end. A sled fixedly attached to the mandrel and slidable along the mast rides with the mandrel downward as the mandrel penetrates the material to be consolidated. The sled supports a compressed air storage tank, and the compressed air storage tank supplies compressed air through a venturi into the mandrel to jet compressed air therein. When the mandrel is at its deepest point, the operator releases a jet of air into the mandrel to disengage the wick drain anchor into the material to be consolidated, and then maintains a constant airflow rate into the mandrel during extraction to equalize the pore pressure of the drainage void and prevent collapse.

14 Claims, 3 Drawing Sheets

PNEUMATIC ANCHORING SYSTEM FOR WICK DRAINS

CROSS-REFERENCE TO RELATED APPLICATION(S)

The present application derives priority from U.S. provisional application Ser. No. 61/547, 423 filed 14 Oct. 2011.

BACKGROUND OF THE INVENTION

1. Field of the Invention

The present invention relates to the installation of wick drains in the construction industry and, more particularly, to an improved pneumatic anchoring system that releases the wick drain anchor plate at depth by a sudden high pressure surge of air, and maintains a predetermined flow rate within the drainage void thereby overcoming the pore pressure at depth.

2. Description of the Background

It is often necessary in construction projects to drain and consolidate unconsolidated earthen materials such as soft wet soil, silt, sand, ore and the like (herein generally referred to as material to be consolidated or soil). Natural drainage can take years, but this can be expedited by creating closely-spaced artificial vertical drainage paths through which the water can flow. Drainage can be accomplished in a matter of weeks. The most common form of artificial drainage paths are called wick drains, and each typically comprises a central polypropylene core surrounded by a geotextile sheath. A typical wick drain is approximately 4 inches wide, ⅛ inch thick, and up to 1,000 feet in length, carried on a roll.

Wick drains installed with specialized equipment called "stitchers." A stitcher is mounted on a backhoe, crane or excavator, and comprises a vertical mast housing an installation mandrel. The wick drain material, which is flexible, is placed within the mandrel. The mandrel is driven into the earth by a vibratory hammer or static method. Once at the desired depth, the mandrel alone is removed from the earth leaving the wick drain material in place. The wick drain material collects pore water from excess pore water pressure in its vicinity to the surface to stabilize the ground at that point.

The mandrel is forcibly driven downwardly into the earth and retracted therefrom with a drive mechanism. Typically the wick drain material is anchored in the earth by a suitable anchor plate attached to the exposed end of the wick which keeps it in place at the lead end of the mandrel. The mandrel advances into the soil pushing the anchor plate into the soil, which in turn pulls the wick drain material from its supply. When the mandrel is fully advanced the anchor plate fixes the wick drain material in the soil ahead of the mandrel, and it remains fixed during mandrel withdrawal.

A primary disadvantage with this form of wick drain anchoring is that the anchors sometimes fail to take hold. The mandrel creates an annulus immediately in front, and within this annulus there is nothing for the anchor plate to take hold of. Once at depth the mandrel is extracted and the advancing anchor plate is released. If the pore pressure at the depth of anchoring is in excess of the pressure inside the mandrel the anchor plate will either come out right along with the mandrel or pull off the mandrel, and the excess pressure outside the mandrel will flood the mandrel causing the wick drain to be severed.

Accordingly, an important object of the present invention is to provide improved apparatus and method for injecting wick drain anchors into the ground.

SUMMARY OF THE INVENTION

It is, therefore, an object of the invention to provide an improved pneumatic mandrel that releases the wick drain anchor plate at depth by a sudden high pressure surge of air and subsequent air flow, thereby overcoming the pore pressure at depth.

In accordance with the foregoing objects, the present invention comprises an improved pneumatic anchoring system for installation and anchoring of wick drains comprising a construction vehicle such as an excavator or crane having an elongate support mast defined by a slot along its length, and a hollow tubular wick drain mandrel slidably carried in the mast. The mandrel is equipped with a seal plate at its upper end to prevent escape of air. An anchoring system is mounted externally on the mast, attached to the mandrel and adapted to traverse the mast downward as the mandrel penetrates the soil. The anchoring system comprises a sled in cooperative engagement with the mast and fixedly attached to the mandrel, a compressed air storage tank riding on the sled, a solenoid valve for controlling an output of compressed air from the tank, and a Venturi in fluid communication between the tank and mandrel for admitting a jet of compressed air into the mandrel. When the mandrel is at its deepest point, actuation of the solenoid releases the wick drain anchor plate by a sudden high pressure surge of air which overcomes the pore pressure at depth. The pore pressure is continually overcome as the mandrel is retracting due to the constant CFM released into the mandrel. This prevents pore pressure from entering the mandrel.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

The present invention is a pneumatic anchoring system for wick drains.

Figure 1:
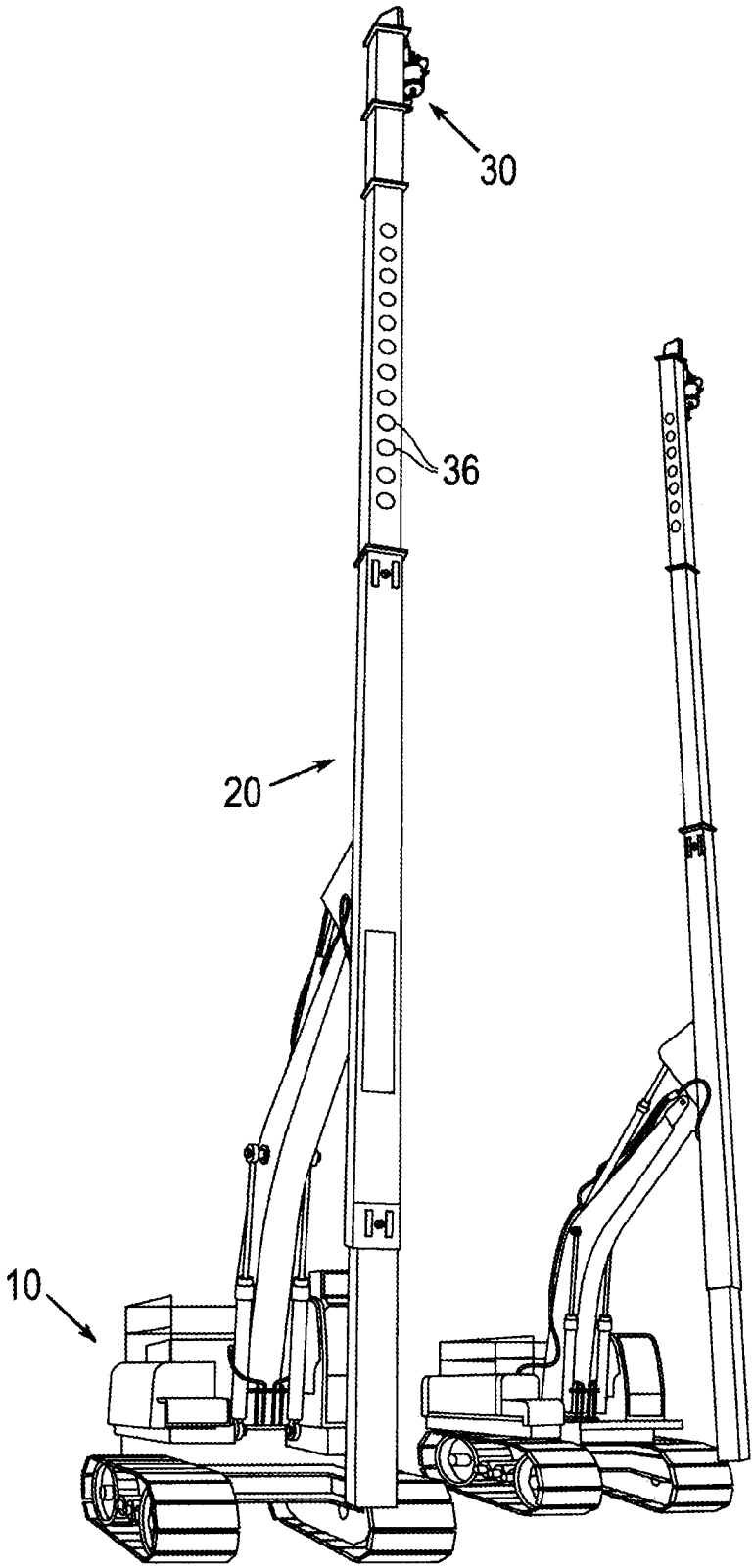
FIG. 1 is a perspective view of a Hyundai 380 excavation vehicle with erect mast supporting a wick drain mandrel (internally), and an external pneumatic anchoring system 30 according to the present invention.
Figure 3:
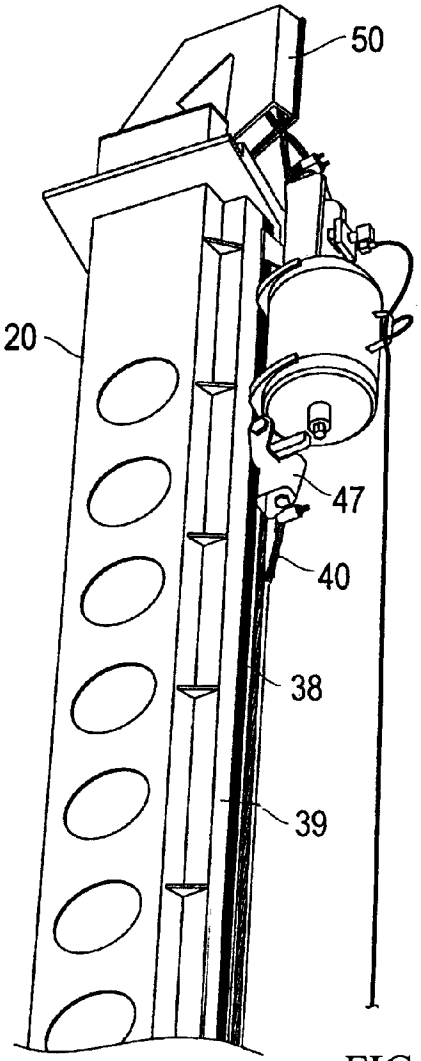
FIG. 3 a photograph side view of the pneumatic anchoring system 30 as in FIG. 2.

FIG. 1 is a perspective photo illustrating an embodiment of the invention installed on a base carrier 10. Either conventional excavators or cranes may be used as base carrier 10, a HYUNDAI™ 380 excavator 10 being illustrated. Base carrier 10 supports a modified mast 20 containing an internal mandrel 36 (mandrel 36 may be internal or external). The mandrel 36 is similar to conventional mandrels in that it is a hollow tubular member adapted to enclose the wick drain material and carry it down into the soil. The mast 20 with mandrel 36 may be configured as a static-push stitcher or vibratory stitcher as known in the art, the former being suited for impact-driving of the mandrel down through the mast 20 into the soil and the latter for vibratory driving.

In accordance with the present invention, the mandrel 36 is attached to and carries a pneumatic anchoring system 30, the pneumatic anchoring system 30 riding the mandrel 36 down as it is driven down through the mast 20 into the soil. When the mandrel reaches its deepest point the pneumatic anchoring system 30 is adapted to inject the mandrel with a burst of pressurized air to dislodge the wick drain anchor (overcoming pore pressure), and to maintain a set cubic feet/minute (cfm) airflow during extraction of the mandrel 36 in order to counteract the pore pressure of the hole. As described below mast 20 is modified to have a vertical track along its length to allow end-to-end transition of the pneumatic anchoring system 30.

Figure 2:
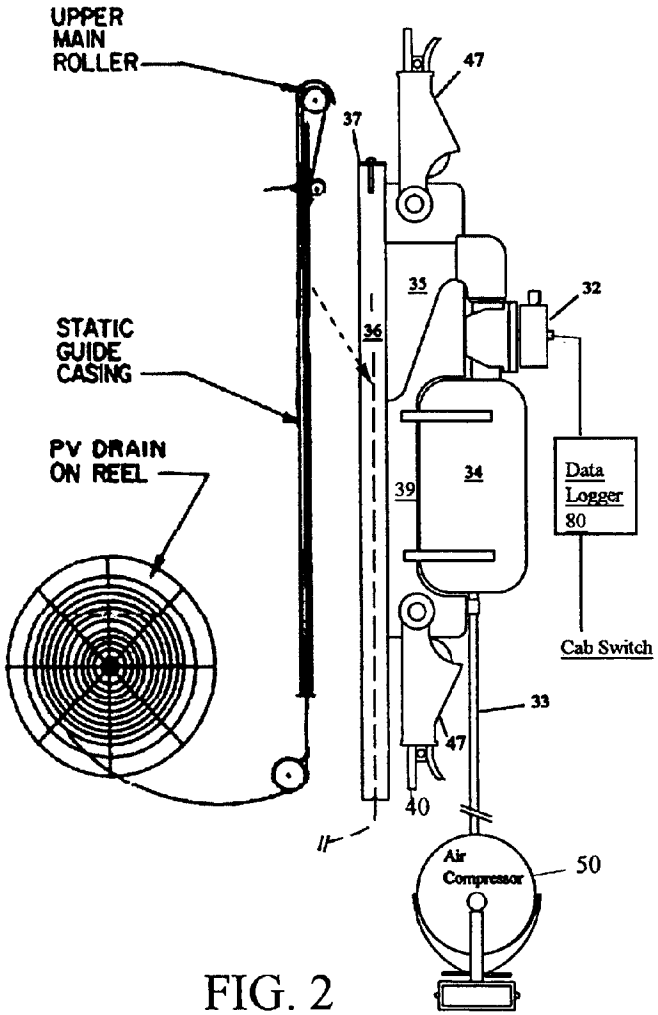
FIG. 2 is a plan side view of the pneumatic anchoring system 30 according to the invention.
Figure 4:
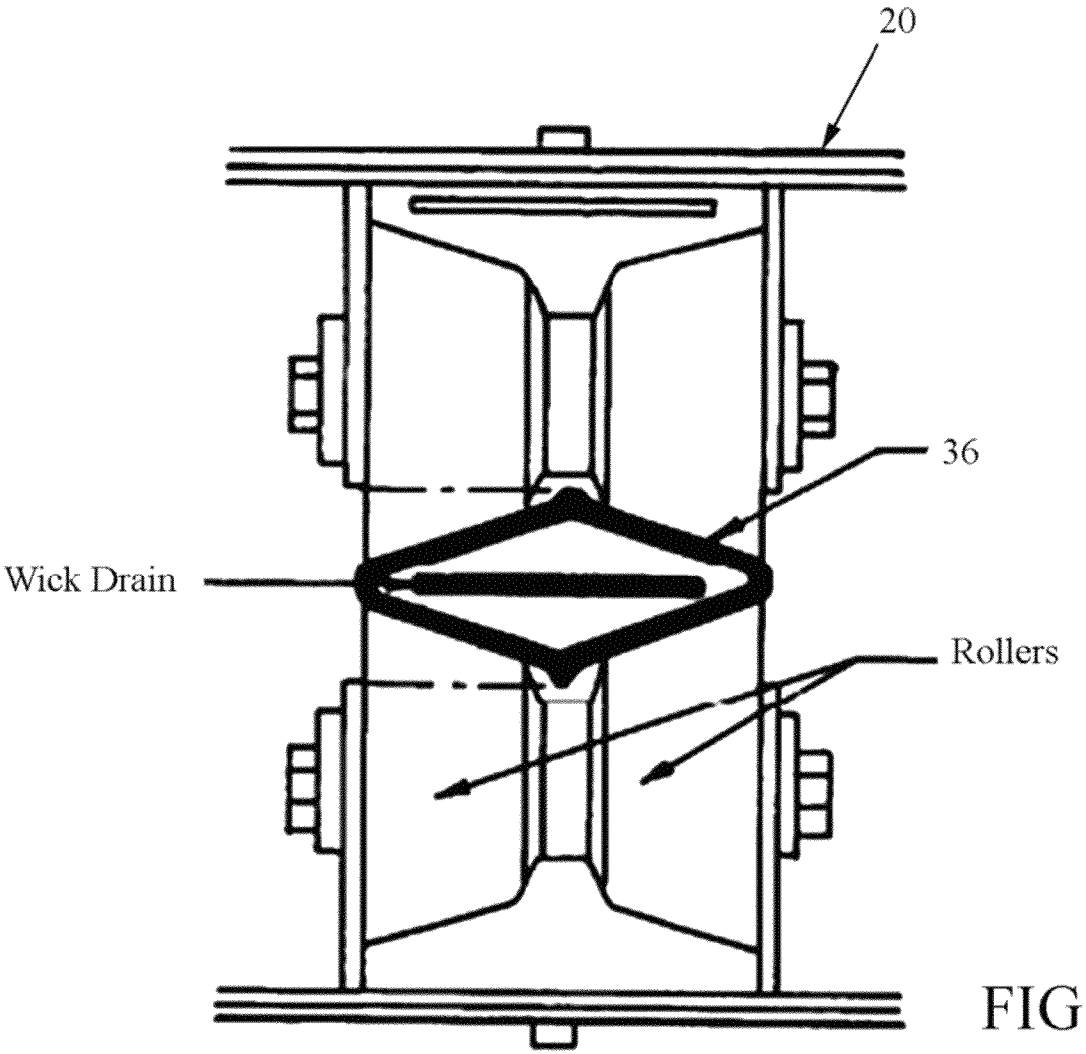
FIG. 4 is a cross-sectional view of the mandrel 36, mast 20 and wick drain material from above.

FIG. 2 is a plan side view of the pneumatic anchoring system 30, which includes an air tank 34 having an inlet and outlet, and an air feed line 33 running from an external source of compressed air 50 (such as a compressor) to the air tank 34 inlet. The air tank 34 outlet is connected to an electric valve 32, such as a 24 VDC Air Solenoid Valve, which controls the flow of compressed air from tank 34 through an air Venturi 35 into mandrel 36. The Venturi 35 is ported into the mandrel 36 along a long narrow slot running lengthwise. The Venturi 35 is a pneumatic coupling with a tapering internal constriction that causes an increase in the velocity of airflow and a corresponding decrease in pressure. The Venturi 35 constriction increases the air velocity and creates a jet effect into the mandrel 36. The wick drain mandrel 36 is a hollow tubular shaft. The upper end of the mandrel 36 is closed off by a seal plate 37 which comprises a round plate seated in a circular collar or grate, and secured thereto by a stud or other suitable fixture. Seal plate 37 minimizes air leakage in the manner of a reed valve, allowing air into the mandrel 36 as needed but preventing escape. The lower end of the mandrel 36 is open or ported for release of the wick material, and for porting the air from Venturi 35. The pneumatic anchoring system 30 is directly attached to the mandrel 36 via the long thin Venturi 35 which passes through a slot 38 running lengthwise along a portion of the mast 20. For better stability the air tank 34 is also preferably mounted on a sled 39 that slides along the mast 20 between opposing guide tracks 39. This way, as the mandrel 36 drives deeper and exits the mast 20 from the bottom, the pneumatic anchoring system 30 follows it down along the mast 20.

In the illustrated embodiment, vibrational or static forces are applied to the mandrel 36 to drive it into the soil through a cable 40 which is attached via a roller clamp 47 to the sled 39. The cable may be connected to an existing excavator or some remote power plant for imparting static tension or vibration.

In operation, an off-axis pile driving or vibrational force imparted to cable 40 digs the mandrel 36 deeper and deeper, sled 39 sliding down along the mast 20 with the mandrel 36 between opposing guide tracks 39. When the mandrel 36 reaches the desired depth the operator activates a cab switch inside excavator 10. This activates the solenoid 32 to open its valve and supply a burst of pressurized air from air tank 34 through the Venturi 35 into mandrel 36. The jet of air serves two purposes. Initially it dislodges the anchor plate attached to the wick drain material from the mandrel 36 and propels it downward into the soil at the bottom of the void. In addition, since the mandrel 36 is sealed at the top end by seal plate 37, the void remains pressurized as a constant CFM is maintained into and out through the mandrel 36 slot, along its entire length, and this continues throughout extraction in order to counteract the pore pressure of the void. The pore pressure is continually overcome as the mandrel 36 is retracting due to the constant CFM released into the mandrel 36. This counterpressure prevents high pore pressure material from entering the mandrel during extraction, facilitates removal of the mandrel 36, and allows the wick drain material time to saturate and commence drainage. The wick drain is then able to reach its maximum discharge capacity (typically 1-2 gpm).

It should now be apparent that the above-described apparatus and method for wick drain insertion equalizes pore pressure at the depth of wick drain and avoids dislodgement of the anchor plate and/or severing of the wick drain.

Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A pneumatic anchoring system for installation of a wick drain in a material to be consolidated, comprising:

an excavation base;

an elongate mast supported by said base;

a hollow tubular mandrel supported by said mast and adapted for downward insertion into said material, said mandrel being configured to removably carry a wick drain with distal anchor inside;

a seal plate seated in an upper end of said tubular mandrel, secured thereto, and configured to operate as a reed valve preventing escape of pressure from within said mandrel and allowing air inflow;

a cable connected to said mandrel for transmitting a force thereto to inject said mandrel carrying said wick drain and anchor into said material;

a sled attached to said mandrel and movable therewith;

a venturi conduit mounted on said sled and in fluid communication with said mandrel for injecting air into the hollow of said mandrel; and an air supply in fluid communication with said venturi conduit for supply of air thereto;

whereby said wick drain distal anchor disengages from the mandrel upon air injection from said venturi so that said mandrel can be removed, while the wick drain remains in the material.

2. The pneumatic anchoring system for installation of a wick drain according to claim 1, wherein said mandrel is slidably carried in said mast.

3. The pneumatic anchoring system for installation of a wick drain according to claim 2, wherein said mast is defined by a slot along its length.

4. The pneumatic anchoring system for installation of a wick drain according to claim 3, wherein said mast is defined by a track along its length.

5. The pneumatic anchoring system for installation of a wick drain according to claim 4, wherein said sled is slidably engaged to said track.

6. The pneumatic anchoring system for installation of a wick drain according to claim 5, wherein said sled is fixedly attached to said mandrel.

7. The pneumatic anchoring system for installation of a wick drain according to claim 6, further comprising a compressed air storage tank attached to said sled.

8. The pneumatic anchoring system for installation of a wick drain according to claim 7, wherein said compressed air storage tank includes an air inlet and an air outlet.

9. The pneumatic anchoring system for installation of a wick drain according to claim 8, further comprising an electronically-controlled solenoid valve at the outlet of said air tank for selectively controlling an output of compressed air from said outlet.

10. The pneumatic anchoring system for installation of a wick drain according to claim 9, wherein said venturi conduit is in fluid communication between the outlet of said air tank and said mandrel.

11. A pneumatic anchoring system for installation of a wick drain having a distal anchor in a material to be consolidated, comprising:

a base;

an elongate mast supported by said base;

a hollow tubular mandrel slidably carried by said mast and adapted for downward insertion into said material, said mandrel being configured to removably carry a wick drain with distal anchor inside, and said mandrel having a cap at one end;

a cable connected to said mandrel for transmitting a force thereto to inject said mandrel carrying said wick drain and anchor into said material;

a sled slidably engaged to said mast and fixedly attached to said mandrel;

a compressed air storage tank attached to said sled and having an air inlet and an air outlet;

a venturi conduit in fluid communication with said mandrel for injecting air into the hollow of said mandrel;

a controllable valve coupled between the outlet of said compressed air storage tank and said venturi conduit; and an air supply in fluid communication with the inlet of said compressed air storage tank for supply of air thereto whereby said wick drain distal anchor disengages from the mandrel upon actuation of said controllable valve to inject air from said venturi conduit so that said mandrel can be removed while the wick drain remains in the material.

12. The pneumatic anchoring system for installation of a wick drain, in a material to be consolidated according to claim 11, wherein said cap comprises a seal plate that allows ingress of air but prevents escape of air.

13. The pneumatic anchoring system for installation of a wick drain according to claim 11, wherein said mast is defined by a track along its length, and said sled is slidably mounted on said track.

14. The pneumatic anchoring system for installation of a wick drain according to claim 11, wherein said valve comprises an electronically-controlled solenoid valve.

* * * * *